United States Patent [19]

Puigrodon

[11] 3,957,187

[45] May 18, 1976

[54] METHODS AND APPARATUS FOR TRANSPORTING AND CONDITIONING WEBS

[76] Inventor: James Puigrodon, Road No. 523, Whitehouse Station, N.J. 08889

[22] Filed: Feb. 11, 1975

[21] Appl. No.: 548,900

[52] U.S. Cl. ..... 226/7; 34/156; 226/97

[51] Int. Cl.[2] ..... B65H 17/32

[58] Field of Search ..... 226/7, 97; 34/156

[56] References Cited

UNITED STATES PATENTS

| | | | |
|---|---|---|---|
| 3,097,971 | 7/1963 | Carlisle | 34/156 X |
| 3,549,070 | 12/1970 | Frost | 226/97 |
| 3,629,952 | 12/1971 | Overly | 34/156 |
| 3,633,281 | 1/1972 | Vits | 226/7 X |

*Primary Examiner*—Richard A. Schacher
*Attorney, Agent, or Firm*—Popper & Bobis

[57] ABSTRACT

A method of and apparatus for transporting and conditioning a web through a conditioning chamber wherein the web pursues a sinusoidal path, being sustained by air issuing from an apparatus having rectangular openings to move air over a convex indentation and tangentially over the surface of a convex nozzle, and a plurality of air jets issuing from orifices in a direction generally perpendicular to the convex nozzle.

13 Claims, 4 Drawing Figures

METHODS AND APPARATUS FOR TRANSPORTING AND CONDITIONING WEBS

BACKGROUND OF INVENTION

1. Field of Invention

This invention relates generally to methods for transporting webs through a conditioning zone, wherein the web pursues a sinusoidal path; the invention also relates generally to an apparatus wherein a moving web is caused to pursue a sinusoidal path between a plurality of nozzles; and particularly, the invention relates to rectangular orifices discharging supporting jets of air over a convex indentation generally tangential to an arcuate surface on the nozzle, sustaining the web by the Coanda Effect; and circular orifices discharging jets of air generally perpendicular to the convex face of a nozzle.

2. Prior Art

In the art of printing or coating paper, fabrics or metal strips, the print or coat must be allowed to dry before the imprinted web can be rolled-up, in order to prevent smudging or marring of the design or coat. Resort to rapid drying coatings or inks does not provide a solution for the problem, because the ink or coat takes time to dry, and the roll-up can only proceed as slowly as the ink or coat dries. The passing of the web through a heated atmosphere is a common expedient, but the web must be sustained as it goes through the drying chamber, otherwise, it may not dry uniformly, or it may, while still wet, contact the interior portions of the chamber or nozzles, and have its coat or design scraped or marred. Thus various chambers for drying have been devised, having many nozzles on both sides of the course over which the web is intended to pass, but these nozzles are not always successful in preventing the moving web from fluttering, wrinkling, or scraping against the nozzle; all of these devices pursue the objective of having the web pursue a precise linear course. To attain this objective, many new nozzles have been devised, e.g. Wallin: U.S. Pat. No. 3,231,165; Schregenberger: U.S. Pat. No. 3,837,551; Frost: U.S. Pat. No. 3,549,070. The nozzles of these devices are able to float lightly coated light, flexible webs with very little contact that may impair the coating or design imprinted, but when it comes to floating webs with rough or sticky coatings, particularly when the webs are of very light material, the webs often wrinkle, flutter and touch the nozzles, so that the design or coat is impaired and the marred portion of the web becomes useless and must be discarded. Eyelid-type air-jet openings may cause dimples in the web, tending to create tension of the web, that results in vibration and fluttering with striping of the coat. When the eye-lid type nozzles are arranged in staggered array, the web edges may flutter. The force of the air discharged may cause portions of the designs to run, splash, or stripe, further marring and impairing the design.

3. Definition

Coanda Effect as referred to herein means the tendency of a gas stream filament to follow the wall contour when discharged adjacent to a surface, and particularly when that surface curves away from the discharge axis of the air stream filament.

SUMMARY OF THE INVENTION

It has been found that, instead of seeking to compel a web to pursue a precisely linear course, nozzles can be provided with openings that cause the web to pursue a sinusoidal course. To accomplish this, the nozzles may be provided with perpendicular, generally rectangular slots, arranged in staggered or offset relation to each other, and facing in opposite directions toward each other. The surface leading from the rectangular slots must not be flat but must be arcuate, leading to the convex face of the nozzle to insure the propagation of the Coanda Effect. In addition, a corresponding nozzle may be provided on the side of the web, staggered or offset from the nozzle on the first side of the web. In this manner, the air discharge force of one nozzle counteracts the air discharge force of the other nozzle. This construction may cause the formation of a series of longitudinal sinusoidal shapes on the web as it moves through the chamber. It is found that the web, in this sinusoidal form is somewhat stiffened against unwanted vibration, flutter and wrinkles. Most efficient use of heated air can be made with a web clearance from the nozzle of 3/16 to 5/16 inch, when the coating is rough or sticky, without risk of marring the coating or design. It is, of course, important that both the top and bottom nozzles must have the same rate of air flow.

A high coefficient of drying depends on several factors: the configuration of the nozzles, the distance between the nozzle and the intended sinusoidal course of the web; the space between adjacent nozzles; the space of one bottom nozzle from an adjacent offset top nozzle, the gaseous drying medium temperature; and the pressure of the discharged air.

A further important distance is the space between adjacent nozzles on the top and the bottom of the sinusoidal course pursued by the web. This space must be sufficient to permit low air return velocities, because high air return velocities will cause flutter and web vibrations that will impair the symmetry of the sinusoidal shape attained by the web, resulting in edge-fluttering.

Nozzles on both sides of the web enhance heat transfer, permit simultaneous drying of coatings or designs on both sides of a web, and insure uniformity of drying of the web in depth when it has a coat of a thick material. Although particular reference has been made to drying, it is to be understood that this invention also has application to cooling moving webs, (metal strips) treating webs in a reactive gaseous atmosphere, curing thermo-sensitive coats on moving webs, irradiating moving webs, and other types of treatment.

THE DRAWINGS

These objects and advantages as well as other objects and advantages may be obtained by the device and procedure shown in the drawings herein:

PREFERRED EMBODIMENT

Figure 1:
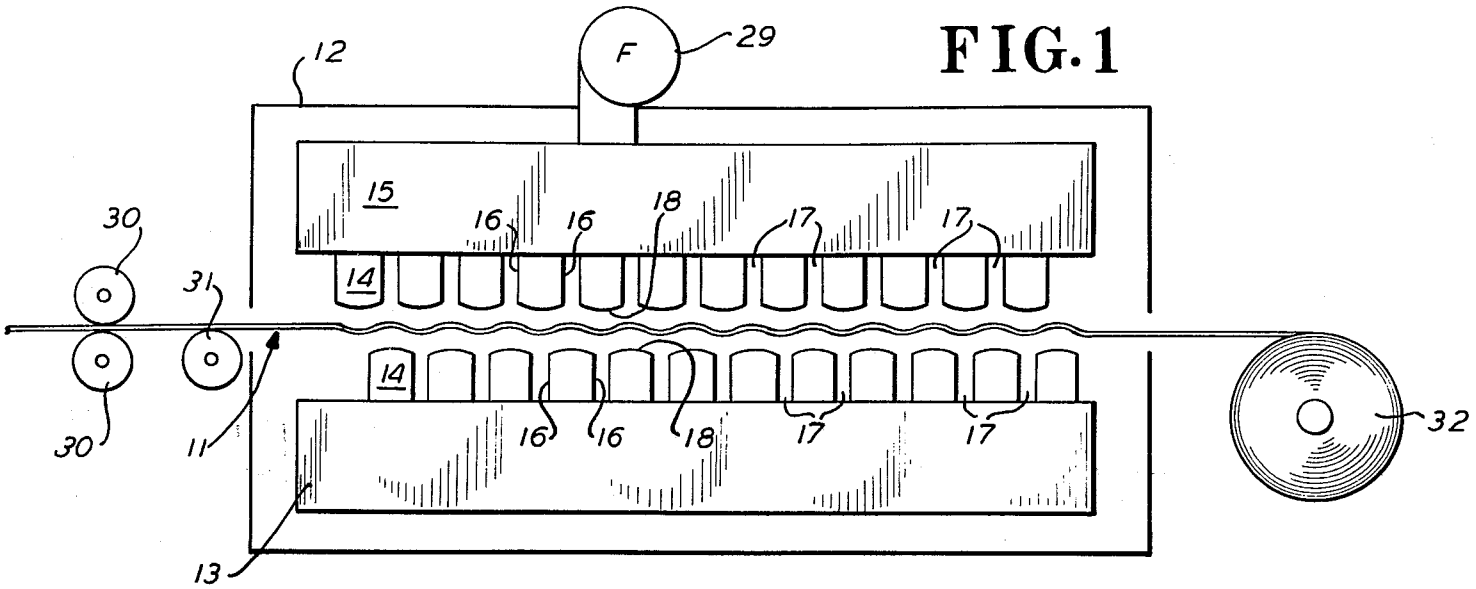
FIG. 1 is a side elevational view of an apparatus for transporting and conditioning webs, having the nearest wall exploded away.
Figure 2:
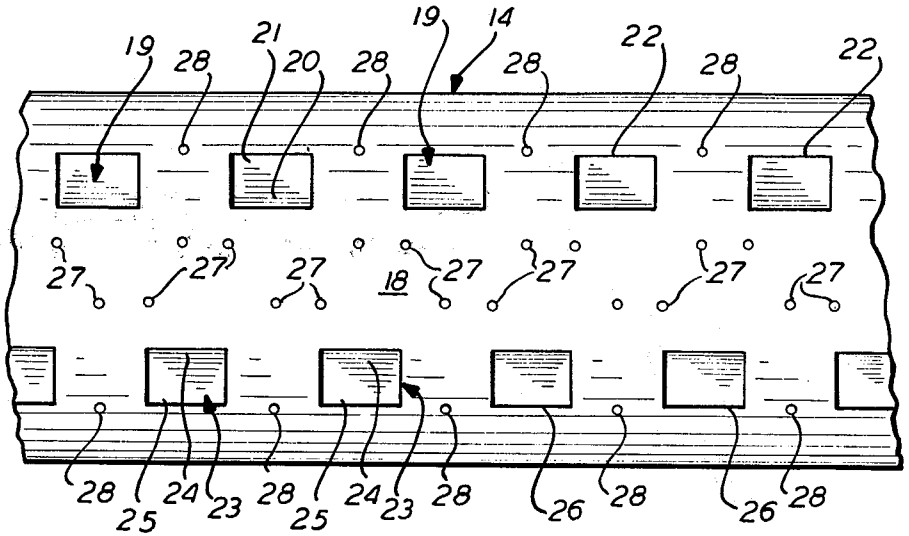
FIG. 2 is a top view of a nozzle member showing the various indentations, slots and orifices.
Figure 3:
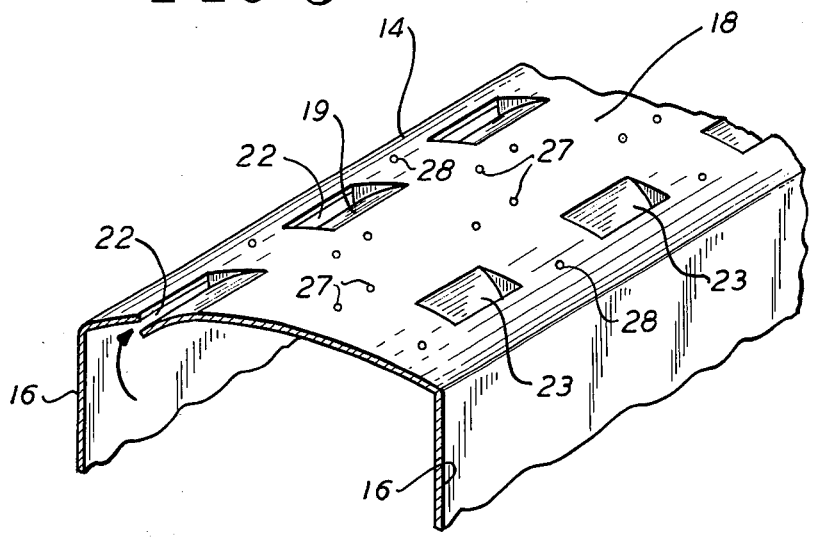
FIG. 3 is a partial view in perspective of a section of a nozzle, showing the slots, orifices and arcuate indentations.
Figure 4:
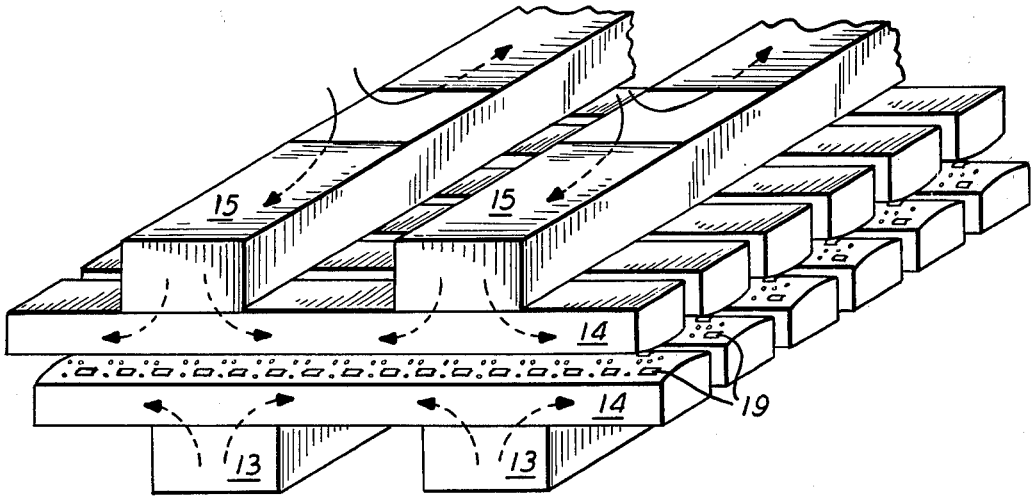
FIG. 4 is a view in perspective of the top and bottom headers connected to the top and bottom nozzles.

Referring now to the drawings in detail, a coated or imprinted web 11 is conducted through a drying chamber 12, going in wet at one end and out dry at the other.

The chamber 12 is provided with at least one, and preferably two bottom headers 13 for conducting air under pressure, and distributing it uniformly to a plurality of transverse hollow bars having a generally rectangular configuration and defining nozzles 14.

There is also provided, a corresponding opposite top header 15, and preferably a pair. The number of headers 13, 15 depends on the width of the web 11 and the velocity of the return air to be achieved. These top headers 15, also conduct air under pressure, and distribute it uniformly to another set of transverse hollow bars defining top nozzles 14. The nozzles 15 of the top headers 15 and the nozzles 14 of the bottom headers are not arranged in vertical registration with each other, but are in fact offset from each other, or arranged in staggered relation so that the bottom nozzles 14 are not directly opposite the top nozzles 14. That is to day, the center of each nozzle 14 is in registration with the center of the space between the opposite nozzle 14.

The nozzles 14 have side walls 16, 16 arranged in parallelism with each other. The distance between the side wall 16 of an adjacent nozzle must not be so great as to allow the air stream filaments to escape from under the web 11 too easily, for if this occurs, the web will not be adequately supported and the sinusoidal course pursued by the web will flatten and permit the web surface to drag on the nozzles 14; also, in such a case, the air stream filaments from the top nozzles 14 will not be unbalanced, and the sinuosity of the web will fail. The best relation of the size of space between side walls 16 of adjacent nozzles 14 has been found to be approximately 0.29 to 0.375 of the distance between the side walls 16 of the interior of each nozzle 14.

In order to attain a sinusoidal web course, the face or end wall 18 of each nozzle 14 must be convex. On this face, near to the side walls 16, generally rectangular indentations 19 are formed, commencing with their shallowest portion 20 toward the center of the end wall 18, and their deepest portion 21, toward the side wall 16. Each indentation 19 terminates in a generally rectangular slot 22. The slots 22 are spaced inwardly from the side walls 16, and are spaced apart from each other a distance equal to their width, although this spacing is not critical. Near the opposite edge of the convex end wall 18, corresponding indentations 23 are found commencing with their shallowest portion 24, toward the center of the end wall 18 and with their deepest part 25 toward the other side wall 16. Likewise, each indentation 23 terminates in a generally rectangular slot 22. The indentations 19 have an airfoil (convex) configuration to initiate the Coanda Effect. This is a vital aspect of the present invention.

The slots 22 are arranged in staggered opposition to the slots 26, and the air discharged from these form air stream filaments which cover the face 18 of the nozzle according to the Coanda Effect. On both sides of a line defining the center of the face, a line of orifices 27 are provided. The orifices 27 are never located close to the discharge orifice of any slots 22, 26 so as not to interfere with the Coanda Effect. In between each of the slots 22, 26, other orifices 28 are located, to provide air jets to complete a balanced air cushion for the web. Since the nozzles 14 on the top 15 and bottom 13 headers are staggered, a sinusoidal course for the moving web is accomplished.

The space 17 between the adjacent top nozzles, and the spaces 17 between the bottom nozzles critically regulates the air cushion to keep the web on its sinuous course, and to prevent fluttering.

Some typical dimension show the preferred embodiment construction. Typically the convex end wall or face 18 may be 5/32 to 7/32 inch higher at the center for a 6 inches distance between the side walls 16 on a radius of approximately 18 to 28 inches. The orifices 27, 28 may be approximately 5/32 to 5/16 inch in diameter for effective lifting of the web 11 and adequate heat transfer.

The laminar flow of air stream filaments over the face 18 of the nozzle is known in the industry as the "Coanda Effect". The combination of laminar flow (Coanda Effect) and jet discharge through the orifices 27, 28 accomplishes the sinusoidal course of the web which is a characteristic of the present invention that imparts stability to the movement of the web through the chamber 12. It is noted that orifices 27 are arranged in two rows on either side of the center line of the face 18 and are staggered with relation to each other; but nevertheless are displaced from the indentations 19, in order that the Coanda Effect shall not be impaired.

At least one fan 29 is provided for pressurizing the headers 13, 15. The rate of air velocity discharge from the slots 22, 26 and the orifices 27, 28 may be approximately 5,000 to 22,000 feet per minute. This precise velocity can be empirically determined with relation to the rate of movement of the web 11 through the chamber 12, the character and width of the web 11, the character of the coating, the temperature of the air, by trial and observation, and no precise velocity can be prescribed for any particular operation.

In FIG. 1, the rollers 30, 30 constituting feed rollers for delivering the web 11 to the chamber 12. The roller 31 represents a dye transfer roller or coating roller for imparting a coat of an ink design transfer to the web. The roller 32 represents a take-up roller for rolling up the web 11 after it issues from the chamber 12.

What is claimed:

1. An apparatus for transporting and conditioning webs comprising:

a. a plurality of top and bottom nozzles,
b. convex end walls on the nozzles,
c. a plurality of indentations on the end walls,
d. a slot in each of the indentations, for gaseous material in the nozzle to emerge therefrom,
e. the indentations from the slot to the convex end wall defining a convex arcuate course,
f. the slots having a generally rectangular shape,
g. orifices in the nozzle positioned in a plane in general registration with the plane defined by the slots and perpendicular to the end wall,
h. the indentations disposed, staggered and offset to each other,
i. side walls on the end walls of the nozzles, and the space between adjacent nozzles is approximately 0.29 to 0.375 of the space inside between the side walls of the nozzles,
j. top and bottom headers for supplying a flow of gaseous material to the nozzles,
k. the top nozzles offset from the bottom nozzles,
l. the top and bottom nozzles disposed in a conditioning chamber,
m. means to conduct a web between the top and bottom nozzles,
n. a plurality of orifices disposed on the convex end walls of the nozzles at both sides a line defining the middle of the convex end walls, but displaced from positions directly in front of each slot.

2. An apparatus for transporting and conditioning webs comprising:

a. a plurality of top and bottom nozzles, b. convex end walls on the nozzles, c. a plurality of indentations on the end walls, d. a slot in each indentation for gaseous material in the nozzles to emerge therefrom, e. the indentations, from the slot to the convex end walls, defining an arcuate course, f. a plurality of orifices disposed on the convex end walls on the nozzles, at both sides of a line defining the middle of the convex end walls, but displaced from positions directly in front of each slot.

3. An apparatus for transporting and conditioning webs according to claim 2 in which the slots are generally rectangular.

4. An apparatus for transporting and conditioning webs according to claim 2 in which orifices are provided in the nozzle positioned in a plane in general registration with the plane defined by the slots, and perpendicular to the end wall.

5. An apparatus for transporting and conditioning webs according to claim 2 in which indentations are disposed staggered and offset to each other.

6. An apparatus for transporting and conditioning webs according to claim 2 in which the nozzles are provided with side walls on the end walls, adjacent nozzle is approximately 0.29 to 0.375 of the space inside of the side walls of the nozzles.

7. An apparatus for transporting and conditioning webs according to claim 2 in which the nozzles are connected to at least one header for supplying a flow of gaseous material to the nozzles.

8. An apparatus for transporting and conditioning webs according to claim 2 in which the top nozzles are offset from the bottom nozzles.

9. An apparatus for transporting and conditioning webs according to claim 2 in which the nozzles are disposed in a conditioning chamber.

10. An apparatus for transporting and conditioning webs according to claim 2 in which there is means for conducting a web between the nozzles.

11. A method for transporting and conditioning a web comprising:

a. discharging gaseous material from generally rectangular slots on a plurality of nozzles, b. providing convex, arcuate Coanda Effect indentations on an end wall of nozzles for the gaseous material to flow over immediately adjacent to the rectangular slots, c. providing a convex Coanda Effect surface on the end walls of the nozzles to receive the gaseous material leaving the convex arcuate indentations, d. arranging the rectangular slots alternately in staggered relation to other opposite rectangular slots on the same nozzle, e. arranging the plurality of nozzles in top ranks and bottom ranks and each rank offset from the other, f. passing the gaseous material stream over the convex surface on the end walls of the nozzles pursuing a Coanda Effect course, g. passing a web between the top and bottom nozzles on a Sinusoidal Course sustained by the Coanda Effect, streams, issuing from the rectangular slots arranged in staggered relation to the other opposite rectangular slots on the same nozzle, h. disposing a plurality of orifices at both sides of a line defined by the middle of the convex surface, but such orifices being displaced from positions directly in front of each slot.

12. The method of transporting and conditioning a web according to claim 11 and discharging gaseous material from orifices positioned alongside of adjacent rectangular slots.

13. The method of transporting and conditioning a web according to claim 11 and discharging gaseous material from orifices positioned on the end walls of the nozzles, which orifices are displaced from positions directly in front of each slot.

* * * * *